US011694867B2

(12) United States Patent
Fragala et al.

(10) Patent No.: US 11,694,867 B2
(45) Date of Patent: Jul. 4, 2023

(54) SILICON NITRIDE X-RAY WINDOW AND METHOD OF MANUFACTURE FOR X-RAY DETECTOR USE

(71) Applicant: Bruker Nano, Inc., Santa Barbara, CA (US)

(72) Inventors: Joseph S. Fragala, Camarillo, CA (US); Xing Zhao, Camarillo, CA (US)

(73) Assignee: Bruker Nano, Inc., Santa Barbara, CA (US)

( * ) Notice: Subject to any disclaimer, the term of this patent is extended or adjusted under 35 U.S.C. 154(b) by 120 days.

(21) Appl. No.: 17/411,197

(22) Filed: Aug. 25, 2021

(65) Prior Publication Data

US 2022/0068635 A1 Mar. 3, 2022

Related U.S. Application Data

(60) Provisional application No. 63/071,042, filed on Aug. 27, 2020.

(51) Int. Cl.

| | |
|---|---|
| ***H01J 5/18*** | (2006.01) |
| ***H01J 9/24*** | (2006.01) |
| ***H01J 9/233*** | (2006.01) |
| *H01J 35/18* | (2006.01) |

(52) U.S. Cl.

CPC ..... *H01J 9/233* (2013.01); *H01J 5/18* (2013.01); *H01J 9/24* (2013.01); *H01J 35/18* (2013.01); *H01J 2235/18* (2013.01)

(58) Field of Classification Search

CPC ..... H01J 9/24; H01J 9/233; H01J 5/18; H01J 35/18; H01J 2235/18

See application file for complete search history.

(56) References Cited

U.S. PATENT DOCUMENTS

| | | | | |
|---|---|---|---|---|
| 6,803,570 | B1 | 10/2004 | Bryson, III et al. | |
| 2013/0077761 | A1* | 3/2013 | Sipila | H01L 31/028 438/57 |

FOREIGN PATENT DOCUMENTS

| | | |
|---|---|---|
| EP | 0912351 | 3/2002 |
| KR | 10-2014-0041576 | 4/2014 |
| WO | 2011-151506 | 12/2011 |
| WO | 2012-091715 | 7/2012 |

OTHER PUBLICATIONS

Brough, "Investigation of Low-Stress Silicon Nitride as a Replacement Material for Beryllium X-Ray Windows", (2012) All Theses and Dissertations. 3402.

* cited by examiner

*Primary Examiner* — Mark R Gaworecki
(74) *Attorney, Agent, or Firm* — Boyle Fredrickson S.C.

(57) ABSTRACT

A method for producing a radiation window includes patterning a photo resist structure onto a double-sided silicon wafer, plasma etching the silicon wafer to create an etched silicon wafer having a silicon supporting structure etched upon a first side of the double-sided silicon wafer, applying a silicon nitride thin film to the etched silicon wafer, patterning a photo resist structure and plasma etching a second side of the double-sided silicon wafer to create an initial window in the silicon nitride thin film, and wet etching the second side of the double-sided silicon wafer to release the silicon nitride thin film and supporting structure from the portion of the double-sided silicon wafer defined by the initial window.

20 Claims, 4 Drawing Sheets

SILICON NITRIDE X-RAY WINDOW AND METHOD OF MANUFACTURE FOR X-RAY DETECTOR USE

CROSS-REFERENCE TO RELATED APPLICATIONS

This application claims priority under 35 USC § 1.119(e) to U.S. Provisional Patent Application No. 63/071,042, filed Aug. 27, 2020. The subject matter of this application is hereby incorporated by reference in its entirety.

BACKGROUND OF THE INVENTION

Field of the Invention

The preferred embodiments are directed to an x-ray window for x-ray detector use, in particular, such a window formed from silicon nitride having a configuration allowing for increased strength and manufacturing ease.

Description of Related Art

X-ray detection, x-ray microscopy and x-ray spectroscopy systems, such as energy dispersive x-ray spectrometer, are used in connection with detecting and sensing emitted radiation. Such systems typically include the components for generating, detecting and sensing the radiation. The detectors are typically shielded in some fashion to prevent unwanted radiation, to allow the detector to be cooled, the maintain a vacuum in the detector etc. In order to shield the detector while also allowing minimizing interference with the x-rays to be measured, a radiation window is provided.

In selecting a radiation window material and configuration, a radiation window's performance is measured in part by its ability to transmit lower-energy x-rays while still being able to withstand a pressure differential with minimal or undetectable vacuum leak rates. Standard radiation windows typically comprise a sheet of material placed over an opening or entrance to the detector. The most desirable materials, reducing the effect on the radiation and maximizing radiation transmission, include the least dense and lowest mass-absorption coefficient materials which are typically the lowest atomic-mass elements. The sheet-material's size, thickness, density, and mass absorption coefficient will also affect the radiation window's radiation transmission. In selecting the material to be used as a radiation window film, higher atomic-mass elements used in the radiation window's sheet material and support structure composition may also cause spectral contamination when used in X-ray spectrometry or fluorescence-type applications. Because of the potential contamination, using the lowest atomic-mass elements in the radiation window's sheet material and support structure composition provides the best radiation window suitable for high-performance energy-dispersive radiation detectors.

Accordingly, it is desirable to provide a radiation window having a material film that is as thin as possible and formed from the lowest atomic-mass elements. However, reducing material thickness and using these elements adversely affects the performance of the window with respect to withstanding cracks, tears, or other failures in harsh environments such as exposure to corrosive chemicals, high temperatures, when subjected to differential pressures, etc. This is particularly true when an x-ray system requires radiation windows provided in larger sizes.

As a solution, radiation window film material has been provided as a thin sheet of lowest atomic-mass element material with a support structure such as frames, screens, meshes, ribs, and grids. However, although such support structure reduces failures in the radiation window film, the support affects the passage of radiation through the window assembly due to the structure's composition, geometry, thickness, and/or height.

Specifically, thin window material requires a support structure to span the window-opening area. The support structure thickness also plays an important role in optimizing radiation transmission. For example, in energy-dispersive radiation-detector applications, the illuminated specimen under examination emits radiation in all directions. Only photons traveling in a direct line-of-sight between the excited element and the radiation detection sensor will enter the sensor without hitting the support structure's ribs or grid sides. If the radiation window's support structure is excessively sized, a significant portion of radiation will be absorbed into the ribs' side walls, effectively collimating radiation that would otherwise be measured. Accordingly, both the width and, to a lesser extent, the height of the radiation window's support structure is sized to maximize support while simultaneously minimizing absorption. For example, decreasing the support structure's height increases the line-of-sight opening between the radiation source and the sensor. In X-ray spectrometry applications, reduced-width and reduced-height support structures minimize radiation collimation, increase radiation flux, and thus decrease sensor reading times.

Silicon can be an ideal material for use as a radiation window's support structure because silicon is a low atomic-mass element that minimizes spectral contamination. Silicon is also ideal because it is easy to etch suitable window frames with well-defined edges and flat sidewalls using established etching techniques. The radiation window support structure must be sufficiently robust to withstand pressure differentials and vibration which occur under normal use. For example, in scanning electron microscopy applications, a sample in a sample container is provided at atmospheric pressure while a vacuum is maintained in the radiation detector inside the radiation window, resulting in a pressure differential of at least a full atmosphere.

Radiation windows used in the field of x-ray detection have traditionally been made with either beryllium thin film or polymer thin film. Both types of radiation windows are known to be relatively weak and fragile such that they cannot withstand harsh environments such as corrosive chemicals, high temperatures, etc. The radiation window is a comparatively inexpensive part of the radiation detector assembly but the radiation window's failure may result in catastrophic damage and require total replacement of the radiation detector.

Radiation windows have been made as silicon nitride window chips for transmission electron microscopic (TEM) sample holders, however these windows have been limited to a small window size. Alternative radiation windows formed from silicon nitride microchips have been made with silicon on insulator (SOI) wafers. However, in such implementations, the buried oxide layer of the SOI wafers results in an isotropic etch, undercutting the masking layer and forming large cavities with sloping sidewalls, causing footing problems, degrading window quality, and stressing the nitride film. SOI wafers are also relatively costly to manufacture.

As a result, a method for producing radiation windows having a silicon nitride film and silicon supporting structure that can be used in detectors with high consistency and low failure rates was desired. What was further needed was such a method of manufacture that was easy to implement and cost-effective.

SUMMARY OF THE INVENTION

The present invention is directed to a method for producing radiation windows preferably having a silicon nitride film and silicon supporting structure that can be used in detectors with high consistency and low failure rates. The method includes performing low pressure chemical vapor deposition on a double-sided polished silicon wafer having a support structure pattern etched thereon to form a wrinkle-free film. The wrinkle free film, supported by the support structure pattern, forms the radiation window when the silicon wafer is etched from the side of the silicon wafer that is opposite the support structure to create a radiation window opening.

In one preferred embodiment, a method for producing a radiation window includes patterning a photo resist structure onto a double-sided silicon wafer, plasma etching the silicon wafer to create an etched silicon wafer having a silicon supporting structure etched upon a first side of the double-sided silicon wafer, applying a silicon nitride thin film to the etched silicon wafer, patterning a photo resist structure and plasma etching a second side of the double-sided silicon wafer to create a silicon exposure area in the silicon nitride thin film, and wet etching the second side of the double-sided silicon wafer to release the silicon nitride thin film and the supporting structure from the portion of the double-sided silicon wafer defined by the silicon exposure area.

In another aspect of this embodiment, plasma etching the silicon wafer to create an etched silicon wafer is performed using reactive ion etching, deep ion etching or magnetically enhanced reactive ion etching.

According to another aspect of this embodiment, the silicon nitride thin film is applied to the etched silicon wafer using a low-pressure chemical vapor deposition.

Another aspect of this embodiment, wet etching the second side of the double-sided silicon wafer to release the silicon nitride thin film includes using any of a anisotropic etch, such as a potassium hydroxide and tetra-methyl ammonium hydroxide wet etching, an isotropic etch, and a Hydrofluoric, Nitric, Acetic (HNA) wet etch.

In a further aspect of this embodiment, the method includes producing a plurality of radiation windows on the double-sided silicon wafer.

In another preferred embodiment, a radiation window assembly in an emissive x-ray detector is provided. The assembly includes a double-sided silicon wafer frame applied with a thin film including a first side including a radiation window side and a second side including a radiation window opening where the thin film and underlying double-sided silicon wafer were etched to create a silicon exposure area. The radiation window opening defines a radiation window within the double-sided silicon wafer frame. The assembly further includes a supporting structure on the first side of the double-side silicon wafer frame positioned inside the radiation window and outside the radiation window opening, where the supporting structure is applied with the thin film.

These and other features and advantages of the invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

Figure 1:
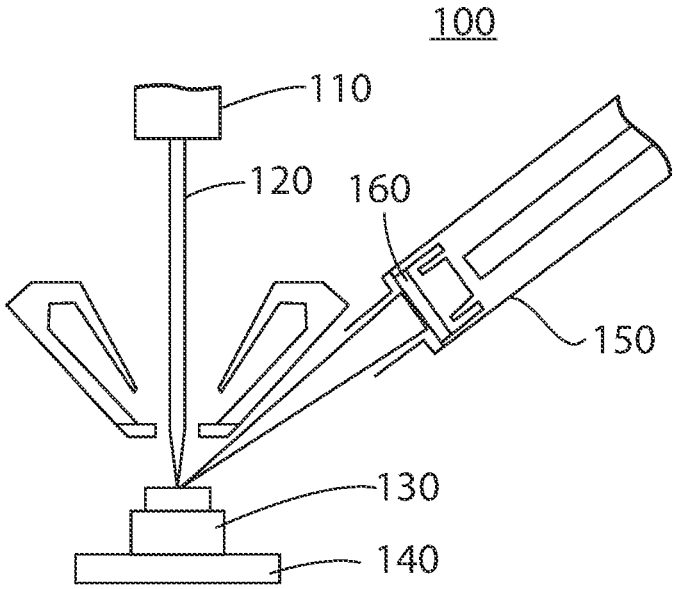
FIG. 1 is a schematic side-elevation view of a spectrometer having a radiation window in an x-ray detector, according to an exemplary embodiment.

Referring first to FIG. 1, a spectrometer 100 is shown, according to an exemplary embodiment. Spectrometer 100 is shown as an energy dispersive spectrometer in FIG. 1 for convenience. Spectrometer 100 includes an energy source 110 generating an energy beam 120 directed at a sample 130 positioned on a stage 140, where energy dispersed from the interaction between energy beam 120 and the sample 130 is detected by a detector 150. Although the spectrometer of FIG. 1 is shown as an energy dispersive spectrometer, one of ordinary skill in the art would understand that the invention described herein can be used in any of a variety of types of detectors requiring the use of a radiation window.

Energy source 110 is configured to generate energy beam 120. Energy beam 120 may be an electron beam, an x-ray beam, etc. For example, energy source 110 may consist of a high voltage power supply (50 kV or 100 kV) and a broad band X-ray tube, usually with a tungsten anode and a beryllium window to generate an x-ray beam. Alternatively, energy source 110 may be an electron gun fitted with an electron source such as a tungsten filament cathode, a cold cathode source, or a field emission source.

Energy beam 120 is directed at sample 130 positioned on stage 140, the sample being in part transparent to electrons, and in part scatters them out of the beam. Energy beam 120 is partially absorbed, partially reflected and partially transmitted by the sample 130. Stage 140 may be any type of specimen holder configured to position the sample 130 to receive the energy beam 120 and allow energy dispersion when the energy beam 120 is illuminating or focused on the specimen through the specimen 130.

More particularly, energy beam 120 is directed at sample 130 with the intent of knocking a deep orbital electron out of the atom. A higher energy shell electron will then drop down into the vacant orbital and emit an x-ray at the transition energy between the two orbitals. When an electron from the inner shell of an atom is excited by the energy of a photon, it moves to a higher energy level. When it returns to the low energy level, the energy which it previously gained by the excitation is emitted as a photon which has a wavelength that is characteristic for the element (there could be several characteristic wavelengths per element). Thus, characteristic x-rays are emitted when the electron beam removes an inner shell electron from the sample, causing a higher-energy electron to fill the shell and release energy. Detector 150 then detects the emitted x-rays. The energy or wavelength of these characteristic x-rays can be measured by detector 150 and used to identify and measure the abundance of elements in the sample 130 and map their distribution. Because atoms have different transition energies due to the depth of their shells, detector 150 can identify the element based on the characteristic x-rays.

Analysis of the x-ray emission spectrum produces qualitative results about the elemental composition of the specimen in energy-dispersive x-ray spectroscopy. Comparison of the specimen's spectrum with the spectra of samples of known composition produces quantitative results (after some mathematical corrections for absorption, fluorescence and atomic number). Analysis of fluorescent radiation by sorting the energies of the photons (energy-dispersive analysis) or by separating the wavelengths of the radiation (wavelength-dispersive analysis) produces qualitative results in x-ray fluorescence. Once sorted, the intensity of each characteristic radiation is directly related to the amount of each element in the material.

X-ray detector 150 includes a radiation window 160, described below in further detail with reference to FIGS. 2 and 3, configured to provide a barrier to maintain a vacuum within detector 150 while also minimizing the effect of the window 160 on transmission of the low energy x-rays from the sample 130. In operation, emitted x-rays enter detector 150 through a collimator assembly that provides a limiting aperture to ensure that only x-rays from the area being excited by energy beam 120 are detected, through an electron trap, configured deflect any passing electrons that could cause background artifacts, to radiation window 160. The x-rays pass through radiation window 160 to a detector crystal and field effect transistor in the detector 150. Detector 150 outputs a charge pulse to a pulse processor (not shown) which measures the electronic signal to determine the energy of each x-ray detected and then to a multichannel analyzer (not shown) which displays and interprets the x-ray data.

Figure 2A:
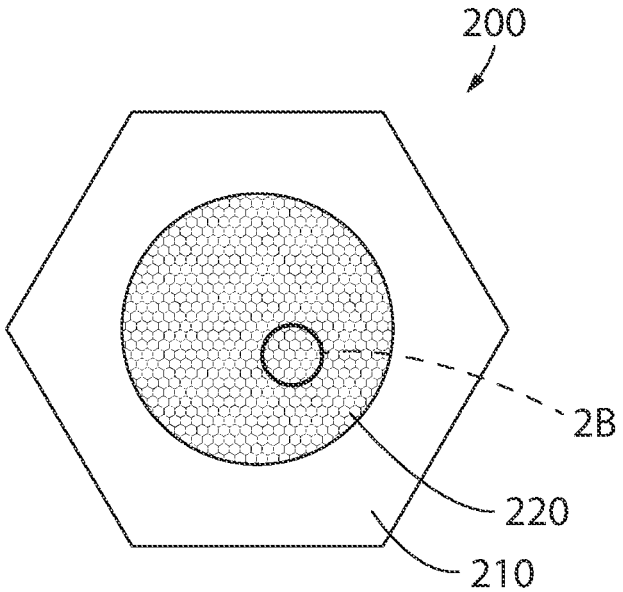
FIG. 2 is an exploded view of the radiation window of FIG. 1, according to an exemplary embodiment.
Figure 2B:
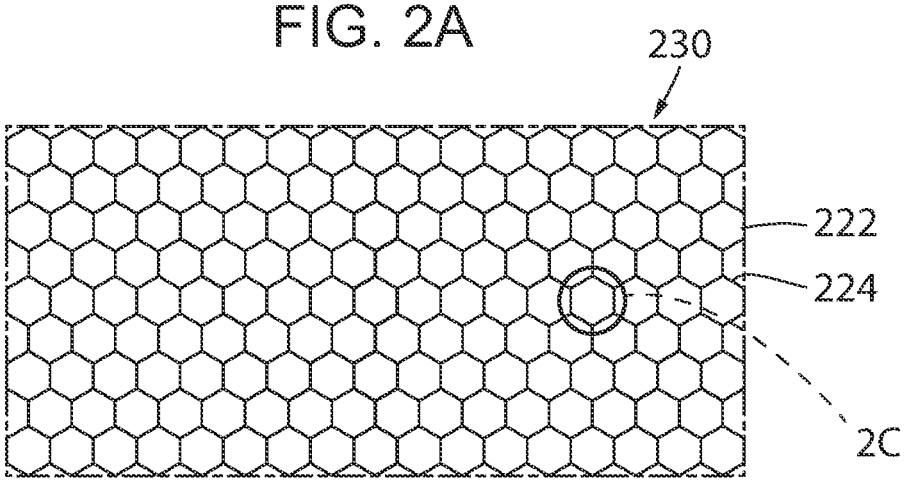
Figure 2C:
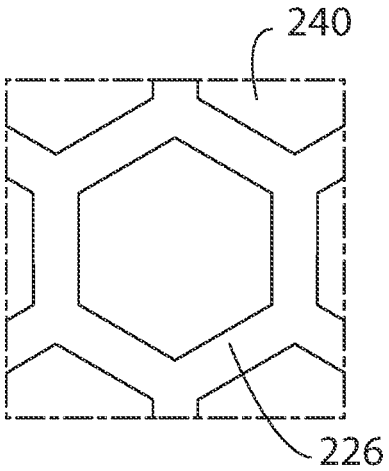
Figure 3:
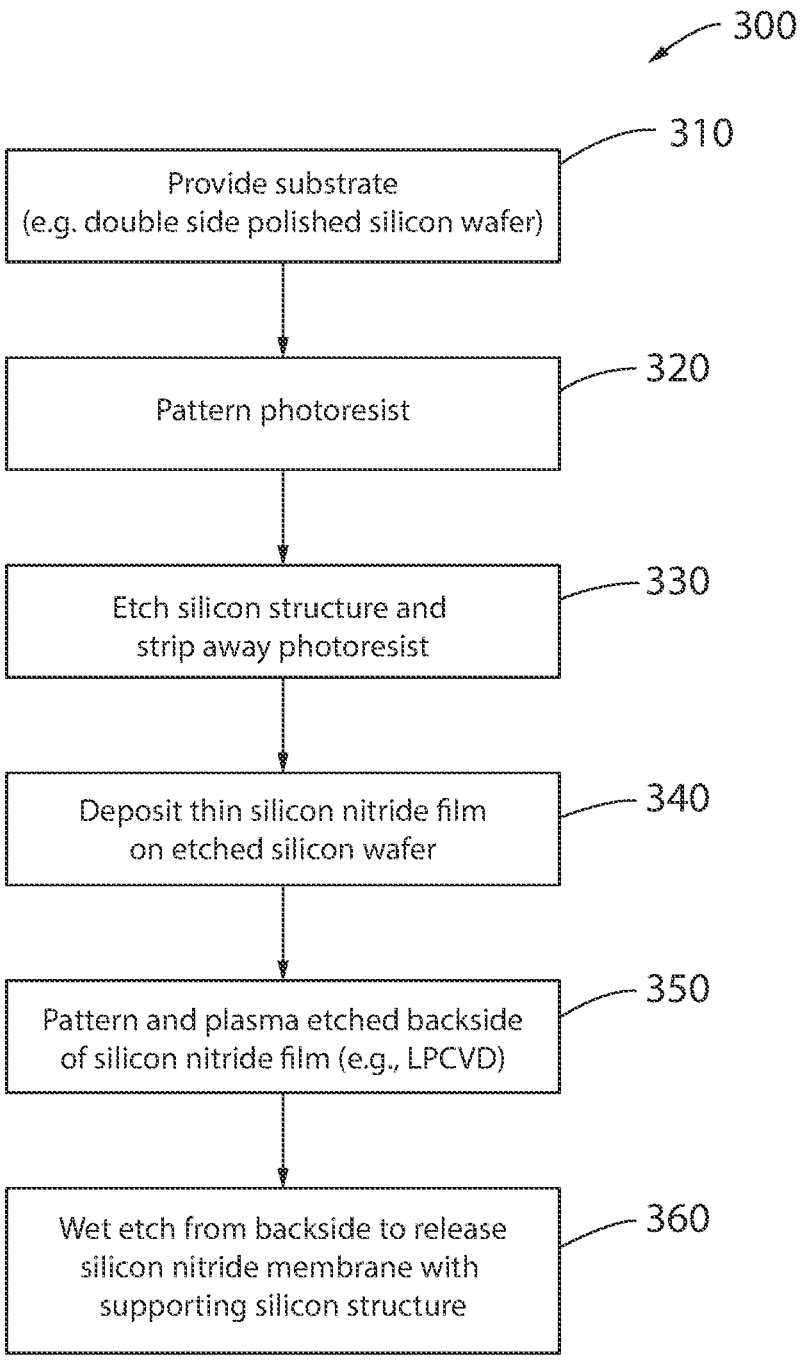
FIG. 3 is a radiation window manufacturing method, according to an exemplary embodiment.

Referring now to FIG. 2, a radiation window 200 formed as described below with reference to FIGS. 3 and 4 is shown, according to an exemplary embodiment. Radiation window 200 may be used in x-ray detector 150 as a radiation window that provides a barrier to maintain the vacuum within detector 150. Radiation window 200 is configured to include a window support frame 210 and a transmissive window 220.

Radiation window 200 is configured to be approximately 30 mm at its widest point-to-point measurement in an exemplary embodiment. Transmissive window 220 is configured to be fifteen (15) mm at its widest point-to-point measurement. One of ordinary skill in the art would recognize that the size of radiation window 200 and transmissive window 220 is relatively larger than traditional implementations of radiation windows for x-ray detectors.

As shown in the exploded view 230, window 220 is configured to include a silicon nitride membrane 222 with a supporting silicon structure 224. Advantageously, the inclusion of supporting silicon structure 224 in the formation of window 220 allows utilization of the relatively fragile silicon nitride membrane 222 in a larger radiation window 200.

According to an additional exemplary embodiment, the supporting silicon structure 224 may be provided in any of a variety of different configurations and geometries. The radiation window support structure geometry contributes significantly to the performance of the transmissive window 220 in transmitting radiation. Support-structure geometry defines the number of ribs or grid density as well as the height, width and length of the individual ribs or grid walls. In the example shown in FIG. 2, in exploded section 240, each of the ribs 226 are configured to be between 2 and 30 μm wide and 10 to 30 μm long and placed to form interlocking hexagons that measure 20 to 60 μm at their greatest width or 17.33 to 52 μm between opposing ribs 226 on each hexagon. Each rib may have a height, typically between 5 and 200 μm.

In considering supporting structure 224 geometry, higher-frequency rib count, higher-grid density, and/or wide grid-wall structures decrease the amount of unobstructed open area, which decreases radiation transmission. Accordingly, the provision of optimal structure-free window area may be balanced with the support provided by the support structure of the membrane 222. Support ribs 226 spaced too far apart or grid density that is too low may cause unacceptable window-film deflection and/or support structure failure when the window must withstand a pressure differential.

Support-structure geometry also is defined by the number of ribs or grid density and the placement of the ribs, such as in the hexagonal placements shown in exploded view 230, as well as the width of the individual ribs or grid walls. The support ribs 226 may be placed within the supporting structure 224 in alternative configurations depending on the desired amount of unobstructed open area as opposed to support structure strength.

As described, membrane 222 is formed as a silicon nitride membrane. According to an alternative embodiment, membrane 222 may be formed as a membrane of polymer, beryllium, or other type of material. The overall thickness of the membrane 222 is 40 nanometers in an exemplary embodiment. Membrane 222 is selected to be composed of a material having a low-z, low atomic number so as to maximize X-ray transmission through the membrane 222. Additional materials may include thin film diamond, thin film diamond-like carbon, boron nitride, etc.

Referring now to FIG. 3 and FIGS. 4A-F, radiation window 200 may be formed using a radiation window manufacturing method 300 that includes a plurality of manufacturing steps illustrated in FIGS. 4A-F.

Figure 4A:
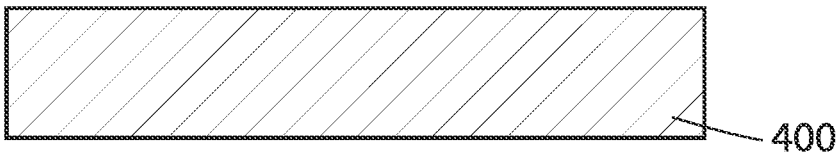
FIGS. 4A-4F are cut away representations depicting the conversion of a silicon wafer into the radiation window of FIG. 2 using the method of FIG. 3.

In block 310, a double-sided polished silicon wafer 400, as shown in FIG. 4A, is provided. An exemplary embodiment, silicon wafer 400 is a bulk silicon wafer that is 300 μm thick. Double sided polished wafers are typically required in semiconductor, microelectromechanical systems (MEMS), and other applications in which wafers with tightly controlled flatness characteristics are required. Double sided wafers are used such that both sides of the wafer may be patterned and etched as described below.

Figure 4B:
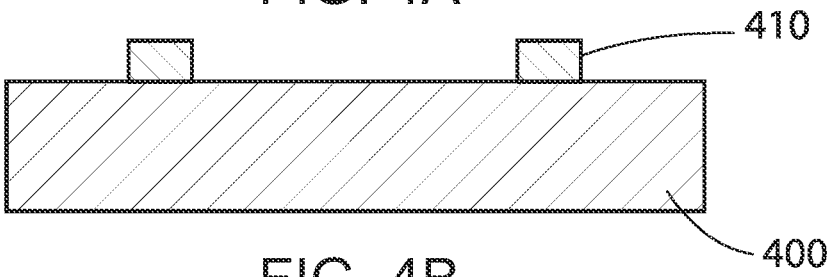

In block 320, a patterned photoresist structure 410, as shown in FIG. 4B, is used as a mask to create the silicon supporting structure 224. The design and strength of the patterned photoresist structure 410 can be easily adjusted as needed depending on window size and surface area. According to an exemplary embodiment, the patterned photoresist structure 410 is the pattern of interlocking hexagonal shapes as shown as described above with reference to FIG. 2.

Figure 4C:
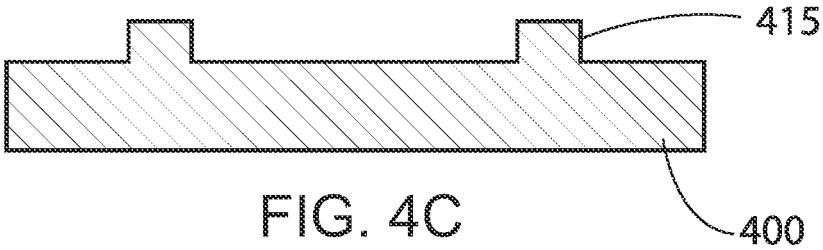

In block 330, after stripping away the photoresist, an etched silicon structure 415, as shown in FIG. 4C, remains on the etched silicon wafer 400. Step 330 is performed using standard photolithography and plasma silicon etch processes to create the supporting structure silicon ribs. In an exemplary embodiment, a reactive ion etching, deep ion etching or magnetically enhanced reactive ion etching is used.

Figure 4D:
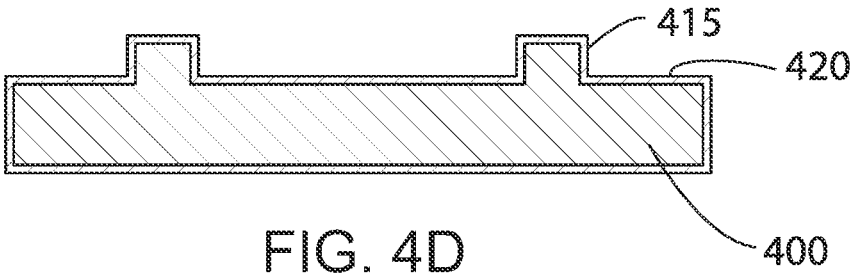

In block 340, a thin low-pressure chemical vapor deposition (LPCVD) silicon nitride film 420 is deposited on the etched silicon wafer 400, as shown in FIG. 4D. LPCVD is used as a deposition method since this technique provides a stronger resultant film 420 in comparison to alternative deposition methods. In an exemplary embodiment, a silicon rich low stress silicon nitride is used as opposed to normal $Si_3N_4$. Because the silicon nitride film 420 is being applied to a polished double-sided wafer, the resultant silicon nitride layer is especially flat and wrinkle free. The resultant flat and wrinkle free silicon nitride file is both tensile and low stress. Further, because the layer is flat wrinkle free and supported by the etched silicon structure 415, and evenly distributed across the etched silicon wafer 400 without wrinkles, the stress across the membrane is relatively low. Depositing the silicon nitride film 420 on the etched silicon wafer 400, in the steps provided herein results in silicon nitride film 420 that is uniform, flat and smooth, such that silicon nitride film 420 provides consistent background with low field variation. In contrast, prior fabrication, utilizing a silicon on insulator (SOI) wafer with etched ribs in thin silicon and stopped on buried oxide, resulted in a wrinkled membrane.

Figure 4E:
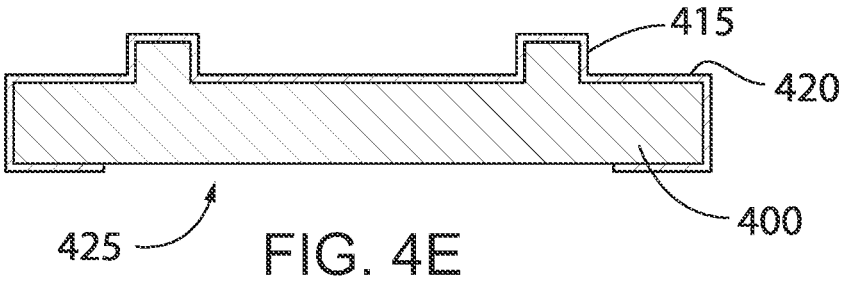

In block 350, the LPCVD silicon nitride film 420 is patterned and plasma etched on the side of the silicon wafer 400 that is opposite the etched silicon structure 415 to define an initial window opening 425, as shown in FIG. 4E.

Figure 4F:
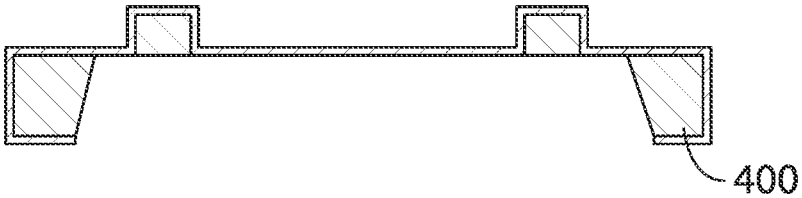

In block 360, as shown in FIG. 4F, Potassium Hydroxide (KOH) or Tetra-Methyl Ammonium Hydroxide (TMAH) wet etching is performed in the silicon exposure area 425 to release the LPCVD silicon nitride film 420, creating the silicon nitride membrane 222 shown in FIG. 2, a radiation window opening in the double-sided silicon wafer 400, and the supporting silicon structure 415, creating the supporting silicon structure 224 also shown in FIG. 2. The specific patterns are defined by initial window opening 425 on the etched silicon wafer 400. Anisotropic wet etching silicon wafer 400 results in a pyramid shaped etch recess, forming the radiation window opening, as shown in FIG. 4F. The etched wall is flat and angled to the surface of the etched silicon wafer 400 at approximately 54.7°.

Advantageously, method 300 allows for mass production of radiation windows using bulk silicon wafers. Using method 300, a multiple of radiation windows may be generated on a single double-sided silicon wafer, dependent on window size. The silicon wafer may be etched around each window to allow window separation. Further, tight control on the etching processing, including temperature, concentrations, bath uniformity, bath timing, etc. allows method 300 to be implemented to provide a dimensionally uniform supporting silicon structures 415 and silicon nitride films 420 across all of the radiation windows and within each radiation window. For example, etching processing, including temperature, concentrations, bath uniformity are required to provide a uniform support structure 224 across the transmissive window 220. Uniformity facilitate batch timing such that the radiation window 200 is removed when the silicon exposure area 425 releases the LPCVD silicon nitride film 420.

The resultant radiation windows are inherently flat and wrinkle free based on the utilization of the double-sided silicon wafers and the method described herein. Further, the supporting structure is uniformly adhered and positioned to the membrane film to ensure that the silicon nitride film, supported by the silicon support structure as recited above, can withstand pressure differentials, corrosive environments and other harsh environments.

Because the method utilizes a tightly controlled method 300, the method does not require the used of etching stops and avoids the undercutting and/or footing problems caused by the buried oxide layer of the SOI wafers. Method 300 results in a smooth, uniform nitride film. Silicon nitride films are mechanically strong, can withstand high differential pressure, and are resistant to high temperature and corrosive environments.

Although certain embodiments contemplated by the inventors of carrying out the present invention are disclosed above, practice of the present invention is not limited thereto. It will be manifest that various additions, modifications and rearrangements of the features of the present invention may be made without deviating from the spirit and scope of the underlying inventive concept.

We claim:

1. A method for producing a radiation window, comprising:

patterning a photo resist structure onto a substrate, plasma etching the substrate to create an etched substrate having a supporting structure etched upon a first side of the substrate, applying a thin film to the etched substrate, patterning a photo resist structure and etching a second side of the substrate to create a silicon exposure area in the thin film; and etching the second side of the substrate to release the thin film and the supporting structure from the portion of the substrate defined by the silicon exposure area.

2. The method according to claim 1, wherein the etching substrate to create an etched substrate step is a plasma etching step that is performed using one of reactive ion etching, deep ion etching, and magnetically enhanced reactive ion etching.

3. The method according to claim 1, wherein the thin film is applied to the etched substrate using a low-pressure chemical vapor deposition.

4. The method according to claim 1, wherein the etching the second side of the substrate to release the thin film step is a wet etching step and includes using one of a potassium hydroxide and tetra-methyl ammonium hydroxide wet etching.

5. The method according to claim 1, wherein the method includes producing a plurality of radiation windows on the substrate.

6. The method according to claim 1, wherein the supporting structure includes a plurality of interlocking hexagons defining an area of the first side of the substrate approximately equivalent in size to the silicon exposure area.

7. The method according to claim 1, wherein the supporting structure has a height between 5 and 200 μm.

8. The method according to claim 1, wherein the radiation windows are sized for use in an energy dispersive spectrometer.

9. The method according to claim 1, wherein the substrate is a double-sided silicon wafer.

10. The method according to claim 1, wherein the supporting structure defines ribs that are at least 50 μm apart.

11. The method according to claim 10, wherein the ribs are between 2 μm and 30 μm wide.

12. The method according to claim 1, wherein the thin film is one of a group including silicon nitride, a polymer, beryllium, diamond, diamond-like carbon, and boron nitride.

13. A radiation window assembly in an emissive x-ray detector, comprising:

a double-sided silicon wafer frame applied with a thin film including, a first side including a radiation window, and a second side including a radiation window opening where the thin film and underlying double-sided silicon wafer were etched to create a silicon exposure area where the radiation window opening defines the radiation window within the double-sided silicon wafer frame; and a supporting structure on the first side of the double-sided silicon wafer frame, wherein the thin film is applied to the supporting structure.

14. The assembly according to claim 13, wherein the double-sided silicon wafer frame is formed using one of reactive ion etching, deep ion etching, and magnetically enhanced reactive ion etching.

15. The assembly according to claim 13, wherein the thin film is a low-pressure chemical vapor deposition film.

16. The assembly according to claim 13, wherein the supporting structure includes a plurality of interlocking hexagons defining an area of the first side of the substrate approximately equivalent in size to the silicon exposure area.

17. The assembly according to claim 13, wherein the supporting structure has a height between 5 and 200 μm.

18. The assembly according to claim 13, wherein the radiation window is sized for use in an energy dispersive spectrometer.

19. The assembly according to claim 13, wherein the supporting structure defines ribs that are at least 50 μm apart.

20. The assembly according to claim 13, wherein the thin film is one of a group including silicon nitride, a polymer, beryllium, diamond, diamond-like carbon, and boron nitride.

* * * * *